US010622702B2

(12) United States Patent
Guo

(10) Patent No.: US 10,622,702 B2
(45) Date of Patent: Apr. 14, 2020

(54) MOBILE TERMINAL AND ANTENNA OF MOBILE TERMINAL

(71) Applicant: BYD COMPANY LIMITED, Shenzhen, Guangdong (CN)

(72) Inventor: Qingyu Guo, Shenzhen (CN)

(73) Assignee: BYD COMPANY LIMITED, Shenzhen, Guangdong (CN)

( * ) Notice: Subject to any disclaimer, the term of this patent is extended or adjusted under 35 U.S.C. 154(b) by 275 days.

(21) Appl. No.: 15/531,074

(22) PCT Filed: Dec. 22, 2015

(86) PCT No.: PCT/CN2015/098286

§ 371 (c)(1),
(2) Date: May 26, 2017

(87) PCT Pub. No.: WO2016/101871

PCT Pub. Date: Jun. 30, 2016

(65) Prior Publication Data

US 2017/0338545 A1 Nov. 23, 2017

(30) Foreign Application Priority Data

Dec. 26, 2014 (CN) ..... 2014 1 0833452
Dec. 26, 2014 (CN) ..... 2014 2 0840199 U

(51) Int. Cl.
*H01Q 1/24* (2006.01)
*H01Q 7/00* (2006.01)
(Continued)

(52) U.S. Cl.
CPC ..... *H01Q 1/242* (2013.01); *H01Q 1/243* (2013.01); *H01Q 1/44* (2013.01); *H01Q 5/335* (2015.01); *H01Q 7/00* (2013.01); *H01Q 21/28* (2013.01)

(58) Field of Classification Search
CPC ..... H01Q 1/242; H01Q 1/243; H01Q 5/335; H01Q 5/378; H01Q 7/00
See application file for complete search history.

(56) References Cited

U.S. PATENT DOCUMENTS 7,315,289 B2 * 1/2008 Puente Baliarda ..... H01Q 1/36 343/817
8,270,914 B2 * 9/2012 Pascolini ..... H01Q 1/243 455/90.2
(Continued)

FOREIGN PATENT DOCUMENTS

CN 102570027 A 7/2012
CN 102738556 A 10/2012
(Continued)

OTHER PUBLICATIONS

International Search Report and Written Opinion from PCT/CN2015/098286 dated Mar. 11, 2016.

*Primary Examiner* — Ab Salam Alkassim, Jr.
(74) *Attorney, Agent, or Firm* — Calfee Halter & Griswold LLP

(57) ABSTRACT

A mobile terminal and an antenna of a mobile terminal are provided. The mobile terminal includes: a printed wiring board; a housing; a metal frame surrounding the housing, having a first frame, a second frame and a third frame, the first frame having a first gap; a first connector connected with a part of the first frame; a second connector connected with the third frame and a ground of the printed wiring board; and a first antenna, including: a main radiator; a first part; a second part; a first inductor; a third part; a fourth part a second inductor connected with the fourth part and a fifth part connected with the second inductor and a first feed terminal of the printed wiring board.

11 Claims, 6 Drawing Sheets

(51) Int. Cl.

| | |
|---|---|
| ***H01Q 21/28*** | (2006.01) |
| ***H01Q 1/44*** | (2006.01) |
| ***H01Q 5/335*** | (2015.01) |

(56) References Cited

U.S. PATENT DOCUMENTS

| | | | | |
|---|---|---|---|---|
| 8,547,283 | B2 * | 10/2013 | Wong | H01Q 1/243 343/700 MS |
| 9,437,925 | B2 * | 9/2016 | Wong | H01Q 5/371 |
| 9,502,768 | B2 * | 11/2016 | Huang | H01Q 1/002 |
| 9,673,512 | B2 * | 6/2017 | Lin | H01Q 1/243 |
| 9,980,018 | B2 * | 5/2018 | Wong | H01Q 5/328 |
| 10,075,203 | B2 * | 9/2018 | Kim | H01Q 5/314 |
| 10,084,236 | B2 * | 9/2018 | Meng | H01Q 7/005 |
| 10,224,630 | B2 * | 3/2019 | Iellci | H01Q 1/243 |
| 10,312,571 | B2 * | 6/2019 | Edwards | H01Q 1/48 |
| 2005/0195124 | A1 * | 9/2005 | Puente Baliarda | H01Q 1/36 343/893 |
| 2009/0273521 | A1 * | 11/2009 | Wong | H01Q 1/38 343/700 MS |
| 2009/0273530 | A1 * | 11/2009 | Chi | H01Q 1/243 343/741 |
| 2010/0149053 | A1 | 6/2010 | Nakano et al. | |
| 2011/0133995 | A1 * | 6/2011 | Pascolini | H01Q 7/00 343/702 |
| 2012/0001815 | A1 * | 1/2012 | Wong | H01Q 1/243 343/749 |
| 2012/0112969 | A1 | 5/2012 | Caballero et al. | |
| 2012/0229347 | A1 | 9/2012 | Jin et al. | |
| 2012/0231750 | A1 * | 9/2012 | Jin | H01Q 7/005 455/77 |
| 2012/0235866 | A1 * | 9/2012 | Kim | H01Q 1/243 343/700 MS |
| 2012/0262345 | A1 * | 10/2012 | Kim | H01Q 1/243 343/702 |
| 2013/0027254 | A1 * | 1/2013 | Korva | H01Q 7/00 343/702 |
| 2013/0057437 | A1 * | 3/2013 | Chiu | H01Q 1/243 343/702 |
| 2013/0113666 | A1 * | 5/2013 | Orsi | H01Q 5/35 343/745 |
| 2013/0135157 | A1 * | 5/2013 | Tsou | H01Q 1/2266 343/702 |
| 2013/0201067 | A1 * | 8/2013 | Hu | H01Q 1/243 343/745 |
| 2014/0055304 | A1 * | 2/2014 | Lin | H01Q 5/335 343/702 |
| 2014/0078008 | A1 * | 3/2014 | Kang | H01Q 5/35 343/702 |
| 2014/0292590 | A1 * | 10/2014 | Yoo | H01Q 1/243 343/702 |
| 2014/0333496 | A1 * | 11/2014 | Hu | H01Q 1/243 343/745 |
| 2014/0361936 | A1 * | 12/2014 | Hallivuori | H01Q 1/243 343/702 |
| 2014/0361948 | A1 * | 12/2014 | Tanaka | H01Q 1/38 343/861 |
| 2015/0102976 | A1 * | 4/2015 | Wong | H01Q 1/243 343/860 |
| 2015/0162659 | A1 * | 6/2015 | Wong | H01Q 5/371 343/729 |
| 2015/0236417 | A1 * | 8/2015 | Iellci | H01Q 1/243 343/850 |
| 2016/0064820 | A1 * | 3/2016 | Kim | H01Q 1/243 343/767 |
| 2016/0118710 | A1 * | 4/2016 | Shin | H01Q 1/241 343/702 |
| 2016/0233574 | A1 * | 8/2016 | Xiong | H01Q 5/50 |
| 2016/0294042 | A1 * | 10/2016 | Wang | H01Q 1/243 |
| 2016/0294060 | A1 * | 10/2016 | Meng | H01Q 1/243 |
| 2016/0329627 | A1 * | 11/2016 | Hong | H01Q 1/243 |
| 2017/0047641 | A1 * | 2/2017 | Kim | H01Q 1/243 |
| 2017/0048363 | A1 * | 2/2017 | Lee | H01Q 1/243 |
| 2017/0264975 | A1 * | 9/2017 | Wong | H01Q 5/328 |
| 2017/0365914 | A1 * | 12/2017 | Hong | H01Q 3/24 |
| 2018/0233807 | A1 * | 8/2018 | Ma | H01Q 1/243 |
| 2018/0261921 | A1 * | 9/2018 | Ha | H01Q 1/243 |
| 2019/0081396 | A1 * | 3/2019 | Zhou | H01Q 3/34 |

FOREIGN PATENT DOCUMENTS

| | | | |
|---|---|---|---|
| CN | 103236583 | A | 8/2013 |
| CN | 203434277 | U | 2/2014 |
| CN | 203536554 | U | 4/2014 |
| CN | 104051842 | A | 9/2014 |
| CN | 203895602 | U | 10/2014 |
| CN | 204424426 | U | 6/2015 |

* cited by examiner

MOBILE TERMINAL AND ANTENNA OF MOBILE TERMINAL

CROSS REFERENCE TO RELATED APPLICATION

This application is based upon International Application No. PCT/CN2015/098286, filed on Dec. 22, 2015, which claims priority and benefits of Chinese Patent Application No. 201410833452.8, filed with State Intellectual Property Office, P. R. C. on Dec. 26, 2014, and Chinese Patent No. 201420840199.4, filed with State Intellectual Property Office, P. R. C. on Dec. 26, 2014, the entire contents of which are incorporated herein by reference.

FIELD

Embodiments of the present disclosure generally relate to a mobile terminal, and more particularly to a mobile terminal and an antenna of the mobile terminal.

BACKGROUND

Nowadays, due to beautiful metal texture, a mobile terminal with metal frame gets more and more popular. However, the metal frame surrounding the antenna can significantly restrain the radiation of the antenna, thus increasing the difficulty for designing such mobile terminal.

For the 4G mobile terminal, in the related art, there are two main solutions currently applied in the diversity antenna, the GPS (Global Positioning System) antenna, and the BT (Bluetooth) & WLAN (Wireless Local Area Network) antenna.

The first solution refers to a traditional solution, i.e. by using FPC (Flexible Printed Circuit) or LDS (Laser Direct Structuring) production process, the antenna is disposed on an isolated plastic bracket or plastic shell. The antenna testing of this solution has no essential difference with that of the traditional mobile terminal with nonmetal frame. The metal frame is used as a part of the antenna ground, meanwhile a gap of about 0.8 mm~1 mm is provided at a proper position of the metal frame, and the ground point of the metal frame is optimized, thus reducing the influence of the metal frame on the antenna testing and the performance of the mobile terminal.

The second solution is that the metal frame is divided into several segments by the gaps and the ground point, and is directly fed, meanwhile the PWB (Printed Wiring Board) is provided with the traditional circuit to obtain the performance and the resonant frequency of the antenna.

The first solution has following disadvantages. By using the traditional design and traditional production process, the cost is high; and what is more, the metal frame cannot be integrated with the antenna, which causes a poor RF performance for the antenna.

The second solution has disadvantages of difficulty on the antenna testing. Because the segmentalized metal frame is directly fed to be the antenna, when the size of the metal frame mismatches the resonance and the radiation of the antenna, it is difficult to perform a manual testing (because it is difficult to enlarge or shorten the size of the metal frame manually), and the production period will be prolonged and the expense will be increased if a new mold is required to be prepared or the old mould is required to be modified.

SUMMARY

Embodiments of the present disclosure seek to solve at least one of the problems existing in the related art to at least some extent.

Embodiments of a first aspect of the present disclosure provide a mobile terminal. The mobile terminal includes: a printed wiring board; a housing; a metal frame surrounding the housing, and having a first frame, a second frame and a third frame, wherein the first frame and the second frame are disposed on two opposite sides of the housing respectively, the third frame is disposed on a top side of the housing and is connected with the first frame and the second frame respectively, and the first frame has a first gap; a first connector, having a first terminal connected with a part of the first frame between the first gap and the third frame and a second terminal; a second connector, having a first terminal connected with the third frame and a second terminal connected with a ground of the printed wiring board; and a first antenna, including: a main radiator of the first antenna consisting of a part of the first frame and a part of the third frame connected between the first connector and the second connector; a first part, having a first terminal connected with the second terminal of the first connector and a second terminal, and parallel with the first frame; a second part, having a first terminal connected with the second terminal of the first part and a second terminal, and parallel with the third frame; a first inductor, having a first terminal connected with the second terminal of the second part and a second terminal connected with the ground of the printed wiring board; a third part, having a first terminal floated and a second terminal, and parallel with the second part, wherein the second part is disposed between the third part and the third frame; a fourth part having a first terminal connected with the second terminal of the third part and a second terminal, and parallel with the first part; a second inductor having a first terminal connected with the second terminal of the fourth part and a second terminal; and a fifth part having a first terminal connected with the second terminal of the second inductor and a second terminal connected with a first feed terminal of the printed wiring board, and parallel with the first part.

The mobile terminal according to embodiments of the present disclosure has the following advantages: first, there is no additional antenna element required, thus greatly reducing a cost; second, using the metal frame as the main radiator and using wiring, feeding and matching in a clearance zone of the printed wiring board, an integrated design is performed on the antenna, thus improving the utilization of the antenna space; third, for the antenna testing during the product development, it is not required to perform a fine adjustment to the shape and dimension of the metal frame, so as to avoid modifying the mold for fabricating the metal frame, to accelerate the development and testing of the antenna, and the testing is convenient and flexible; fourth, in the premise of ensuring the necessary antenna RF performance, the antenna occupies a small area of the printed wiring board, which greatly saves the valuable space of the printed wiring board.

Embodiments of a second aspect of the present disclosure provide an antenna of the mobile terminal, the antenna of the mobile terminal includes: a first antenna part having a first terminal grounded and a second terminal; a second antenna part, having a rectangular shape with an opening, wherein the opening has a first terminal connected with the second terminal of the first antenna part and a second terminal, the first antenna part is perpendicular to one side of the rectangular shape of the second antenna part where the opening is disposed; a first inductor having a first terminal connected with the second terminal of the first antenna part and a second terminal connected with the second terminal of the opening; a third antenna part, having a first terminal and a second terminal floated, and parallel with the one side of the rectangular shape of the second antenna part; and a second inductor having a first terminal connected with the first terminal of the third antenna part and a second terminal connected with a power supply of a printed wiring board.

The antenna of the mobile terminal according to embodiments of the present disclosure has the following advantages: first, there is no additional antenna element required, thus greatly reducing a cost; second, for the antenna testing during the product development, it is not required to perform a fine adjustment to the shape and dimension of the metal frame, so as to avoid modifying the mold for fabricating the metal frame, to accelerate the development and testing of the antenna, and the testing is convenient and flexible; third, in the premise of ensuring the necessary antenna RF performance, the antenna occupies a small area of the printed wiring board, which greatly saves the valuable space of the printed wiring board.

Additional aspects and advantages of embodiments of present disclosure will be given in part in the following descriptions, become apparent in part from the following descriptions, or be learned from the practice of the embodiments of the present disclosure.

BRIEF DESCRIPTION OF THE DRAWINGS

These and other aspects and advantages of embodiments of the present disclosure will become apparent and more readily appreciated from the following descriptions made with reference to the accompanying drawings, in which.

DETAILED DESCRIPTION

Figure 1:
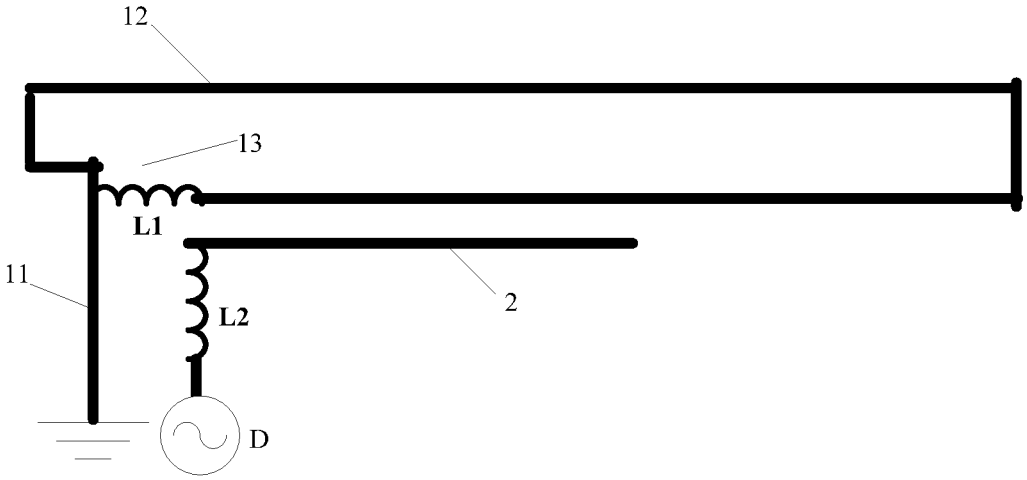
FIG. 1 is a schematic diagram of an antenna of the mobile terminal according to an embodiment of the present disclosure.

Reference will be made in detail to embodiments of the present disclosure. Embodiments of the present disclosure will be shown in drawings, in which the same or similar elements and the elements having same or similar functions are denoted by like reference numerals throughout the descriptions. The embodiments described herein according to drawings are explanatory and illustrative, not construed to limit the present disclosure.

Various embodiments and examples are provided in the following description to implement different structures of the present disclosure. In order to simplify the present disclosure, certain elements and settings will be described. However, these elements and settings are only by way of example and are not intended to limit the present disclosure. In addition, reference numerals may be repeated in different examples in the present disclosure. This repeating is for the purpose of simplification and clarity and does not refer to relations between different embodiments and/or settings. Furthermore, examples of different processes and materials are provided in the present disclosure. However, it would be appreciated by those skilled in the art that other processes and/or materials may be also applied. Moreover, a structure in which a first feature is "on" a second feature may include an embodiment in which the first feature directly contacts the second feature, and may also include an embodiment in which an additional feature is formed between the first feature and the second feature so that the first feature does not directly contact the second feature.

In the description of the present disclosure, unless specified or limited otherwise, it should be noted that, terms "mounted," "connected" and "coupled" may be understood broadly, such as electronic connections or mechanical connections, inner communications between two elements, direct connections or indirect connections through intervening structures, which can be understood by those skilled in the art according to specific situations.

With reference to the following descriptions and drawings, these and other aspects of embodiments of the present disclosure will become apparent. In the descriptions and drawings, some particular embodiments are described in order to show the principles of embodiments according to the present disclosure, however, it should be appreciated that the scope of embodiments according to the present disclosure is not limited herein. On the contrary, changes, alternatives, and modifications can be made in the embodiments without departing from spirit, principles and scope of the attached claims.

In the following, an antenna of the mobile terminal and a mobile terminal are described in detail with reference to drawings.

FIG. 1 is a schematic diagram of an antenna of the mobile terminal according to an embodiment of the present disclosure. As shown in FIG. 1, the antenna of the mobile terminal includes a first antenna part 11, a second antenna part 12, a first inductor L1, a third antenna part 2, and a second inductor L2. The first antenna part 11 has a first terminal grounded and a second terminal. The second antenna part 12 has a rectangular shape with an opening 13, the opening 13 has a first terminal connected with the second terminal of the first antenna part 11 and a second terminal. The first antenna part 11 is perpendicular to one side of the rectangular shape of the second antenna part 12 where the opening 13 is disposed. The first inductor L1 has a first terminal connected with the second terminal of the first antenna part 11 and a second terminal connected with the second terminal of the opening 13. The third antenna part 2 has a first terminal and a second terminal, and is parallel with the one side of the rectangular shape of the second antenna part 12. The second terminal of the third antenna part 2 is floated. The second inductor L2 has a first terminal connected with the first terminal of the third antenna part 2 and a second terminal connected with a power supply D of a printed wiring board.

In an embodiment, the antenna of the mobile terminal can be disposed on a clearance zone of the printed wiring board at an upper left corner or an upper right corner of the mobile terminal, the ground of the printed wiring board is disconnected on the clearance zone of the printed wiring board. An area of the clearance zone of the printed wiring board is about 10*12 mm, the clearance zone of the printed wiring board reserves the dielectric substrate of the printed wiring board to hold antenna lines of the mobile terminal (such as the first antenna part 11, the second an antenna part 12 and the third antenna part 2) and to place antenna matching devices (such as the first inductor L1 and the second inductor L2).

In an embodiment, a concept form of the antenna of the mobile terminal is evolved from a "Loop" antenna ("Loop" indicates that a shape of the antenna according to embodiments of the present disclosure is "loop-shaped" but the antenna according to embodiments of the present disclosure is not a real conventional loop antenna) with a terminal grounded. A parallel antenna (i.e. the first inductor L1), a capacitive coupling feed, and a series inductor (i.e. the second inductor L2) are introduced in the "Loop" antenna, such that the "Loop" antenna having only one resonant mode excites two resonant modes, thus extending the bandwidth or obtaining a dual-band resonant mode.

An evolution process of the concept form of the antenna of the mobile terminal is illustrated as follows.

Figure 2:
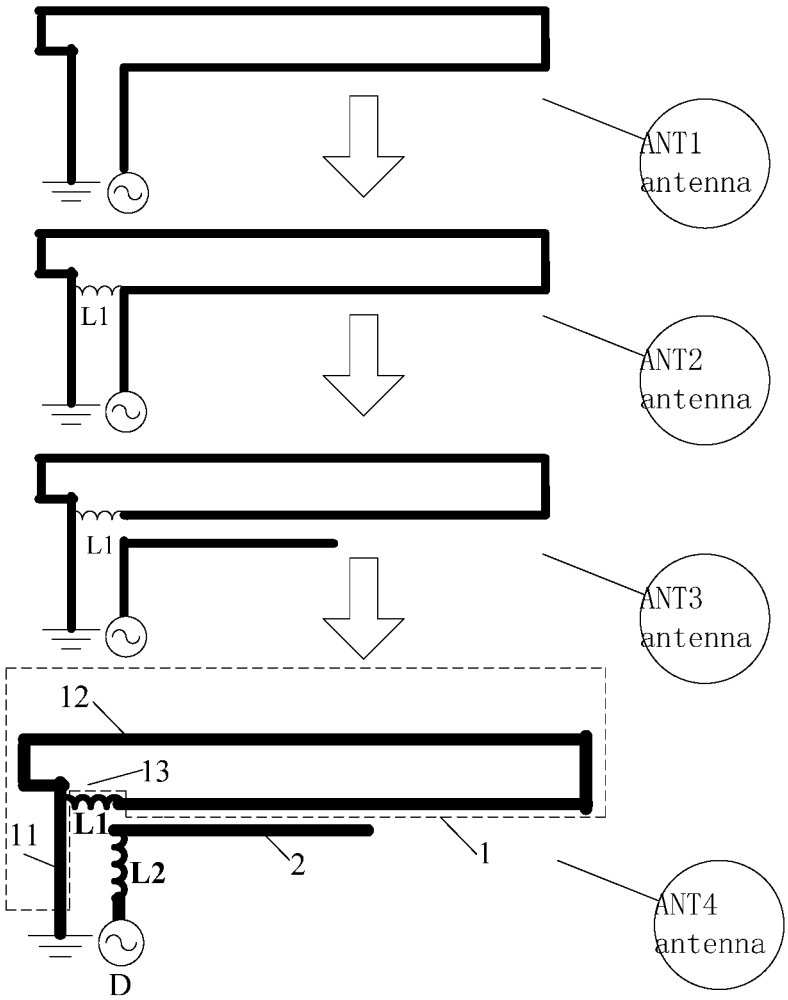
FIG. 2 is a schematic diagram showing an evolution process of a concept form of an antenna of a mobile terminal according to an embodiment of the present disclosure.
Figure 3:
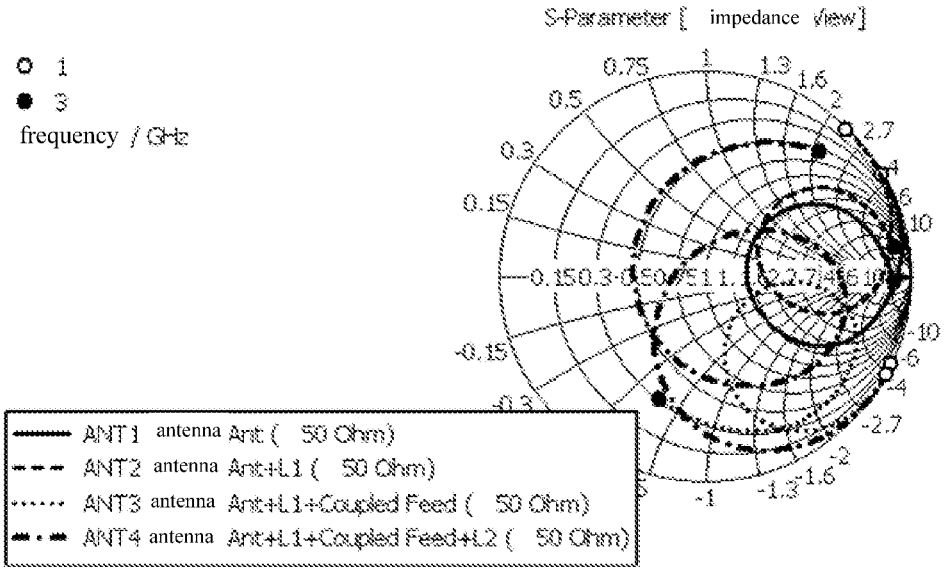
FIG. 3 is a schematic diagram showing an impedance frequency curve corresponding to each generation of antenna shown in FIG. 2.
Figure 4:
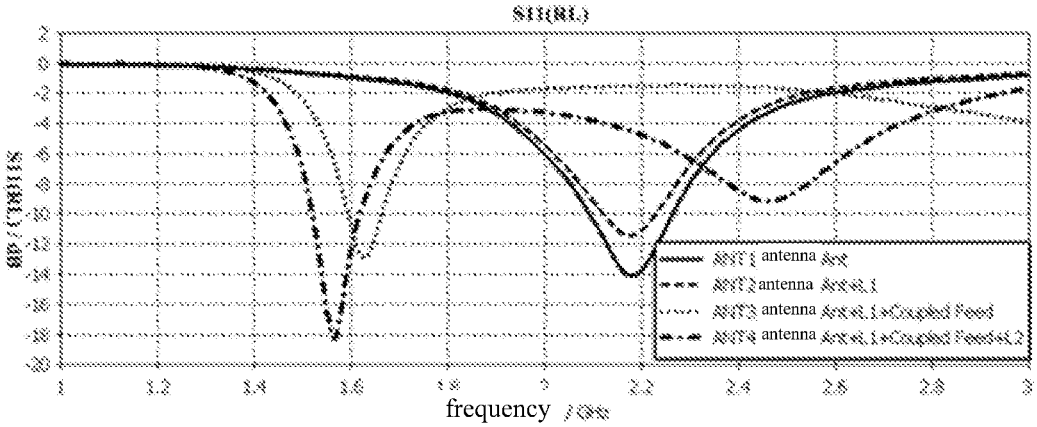
FIG. 4 is a schematic diagram showing an RL frequency curve corresponding to each generation of antenna shown in FIG. 2.

FIG. 2 is a schematic diagram showing an evolution process of a concept form of an antenna of a mobile terminal according to an embodiment of the present disclosure. As shown in FIG. 2, an ANT1 antenna is an original state of the antenna, the ANT1 antenna is a "Loop" antenna with a terminal grounded. FIG. 3 is a schematic diagram showing an impedance frequency curve corresponding to each generation of antenna shown in FIG. 2. FIG. 4 is a schematic diagram showing an RL frequency curve corresponding to each generation of antenna shown in FIG. 2. As shown in FIG. 3 and FIG. 4, the ANT1 antenna only has one resonant frequency (about 2.18 GHz). Furthermore, a shape and a size of the ANT1 antenna are not designed for a particular frequency band, such that an optimized antenna impedance is not obtained, but an ANT2 antenna, an ANT3 antenna and an ANT4 antenna can excite for the particular frequency band (such as GPS band, BT & WLAN band) to obtain a desired resonant mode and band width.

As shown in FIG. 2, the loop of the ANT1 antenna is connected with the first inductor L1 with an appropriate inductance (the first inductor L1 is configured to reduce a loop area of the ANT1 antenna, and to play a role of matching parallel inductor in a normal sense because a low-pass characteristic of the first inductor L1 mainly lies in changing an equivalent loop area of a low frequency band) in parallel to form the ANT2 antenna, and thus an antenna impedance of the ANT2 antenna (such as an antenna impedance with respect to GPS frequency band (1.565~1.585 GHz)) shifts to an inductance area matching with the capacitive coupling feed. As shown in FIG. 3 and FIG. 4, it can be seen that the antenna impedance of the ANT2 antenna has a fine adjustment, particularly in the impedance of the low frequency band, but which influents slightly on an RL curve of the ANT2 antenna particularly on a resonant frequency of the ANT2 antenna.

As shown in FIG. 2, based on the ANT2 antenna, a direct feed is changed into a capacitive coupling feed to form the ANT3 antenna, and a coupling capacitance of the ANT3 antenna may be fine adjusted by adjusting both a size of a space gap between wires and a cross area. As shown in FIG. 3 and FIG. 4, it can be seen that an antenna impedance of the ANT3 antenna has a significant deflection (most of the antenna impedance of the ANT3 antenna is deflected to a capacitance zone) by the appropriate capacitive coupling feed (the capacitance coupling feed can be approximately equivalent to connecting a capacitor in a feed circuit in series for matching), meanwhile, a resonance is excited around the GPS frequency band.

As shown in FIG. 2, based on the ANT3 antenna, the second inductor L2 with an appropriate inductance is connected in the feed circuit (the feed loop comprises the first antenna part 11, the second antenna part 12, the first inductor L1 and the third antenna part 2) in parallel to form the ANT4 antenna. The ANT4 antenna is the antenna provided in the embodiments of the present disclosure. As shown in FIG. 3 and FIG. 4, it can be seen that compared with the antenna impedance of the ANT3 antenna, an antenna impedance of the ANT4 antenna is deflected from the capacitance zone to an inductance zone because of an existence of the second inductor L2 connected in the feed circuit in series, a resonance is excited in the BT & WLAN frequency band (2.4~2.485 GHz), while a low frequency impedance of the ANT4 antenna is also fine adjusted, such that a resonance excited by the capacitive coupling feed of the ANT3 antenna is fine adjusted to the GPS frequency band (1.565~1.685 GHz).

Figure 5:
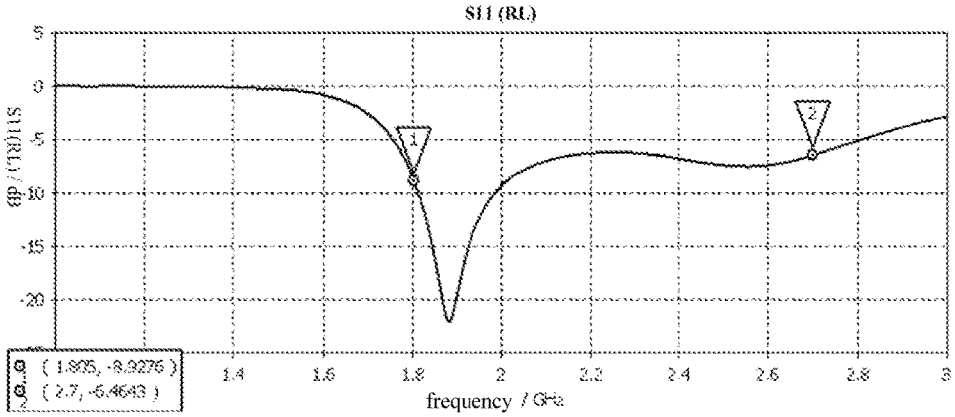
FIG. 5 is a schematic diagram showing an RL frequency curve corresponding to an ANT4 antenna according to an embodiment of the present disclosure.
Figure 6:
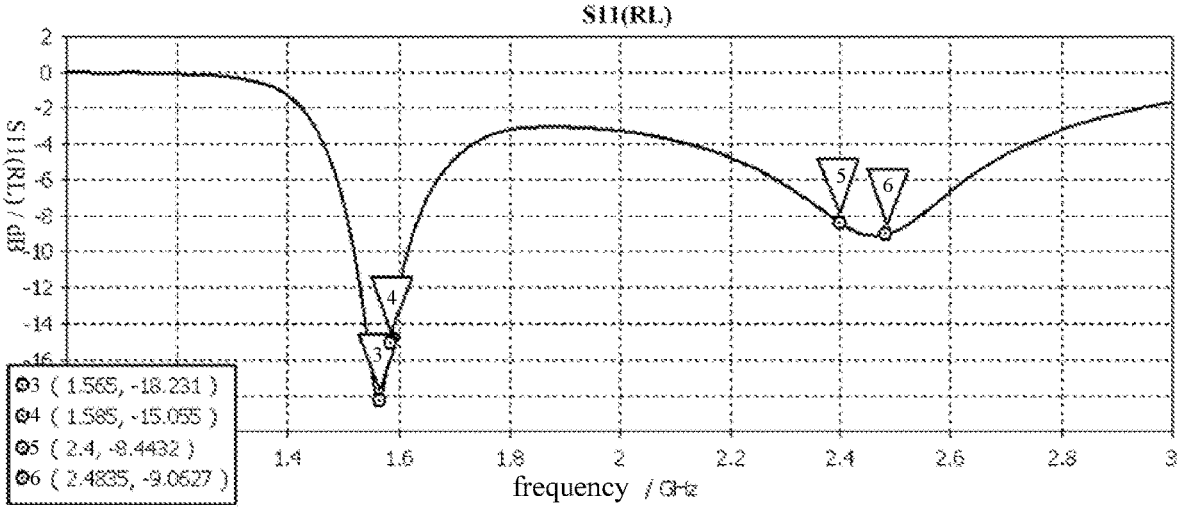
FIG. 6 is a schematic diagram showing an RL frequency curve corresponding to an ANT4 antenna according to another embodiment of the present disclosure.

FIG. 5 is a schematic diagram showing an RL frequency curve corresponding to the ANT4 antenna according to an embodiment of the present disclosure. FIG. 6 is a schematic diagram showing an RL frequency curve corresponding to the ANT4 antenna according to another embodiment of the present disclosure. In the RL frequency curve shown in FIG. 5, two resonant frequency excited by the ANT4 antenna are close to each other, and thus the RL bandwidth of a single frequency band may be designed wider applicable for LTE diversity antennas. In the RL frequency curve shown in FIG. 6, two resonant frequencies (low frequency resonances 3, 4 and high frequency resonances 5, 6) excited by the ANT4 antenna is relatively far away from each other, which can be used as a dual band antenna applicable for the GPS antenna and the BT & WLAN antenna.

In an embodiment, the conventional "Loop" antenna is evolved and improved by introducing a parallel inductor (i.e. the first inductor L1) in the loop, the capacitive coupling feed and a series inductor (i.e. the second inductor L2) in the feed circuit, such that an impedance conversion effect identical with an impedance conversion effect achieved by performing a fine adjustment on the shape and the size of antenna radiators (i.e., a metal frame) is obtained by changing the inductance of the parallel inductor in the loop, and the mode of the antenna is changed from a narrowband single resonant mode to a broadband dual resonant mode (i.e., two fine-adjustable resonant modes are excited from the single resonant mode).

The mobile terminal according to embodiments of the present disclosure has the following advantages: first, there is no additional antenna element required, thus greatly reducing a cost; second, using the metal frame as the main radiator and using wiring, feeding and matching in a clearance zone of the printed wiring board, an integrated design is performed on the antenna, thus improving the utilization of the antenna space; third, for the antenna testing during the product development, it is not required to perform a fine adjustment to the shape and dimension of the metal frame, so as to avoid modifying the mold for fabricating the metal frame, to accelerate the development and testing of the antenna, and the testing is convenient and flexible; fourth, in the premise of ensuring the necessary antenna RF performance, the antenna occupies a small area of the printed wiring board, which greatly saves the valuable space of the printed wiring board.

Figure 7:
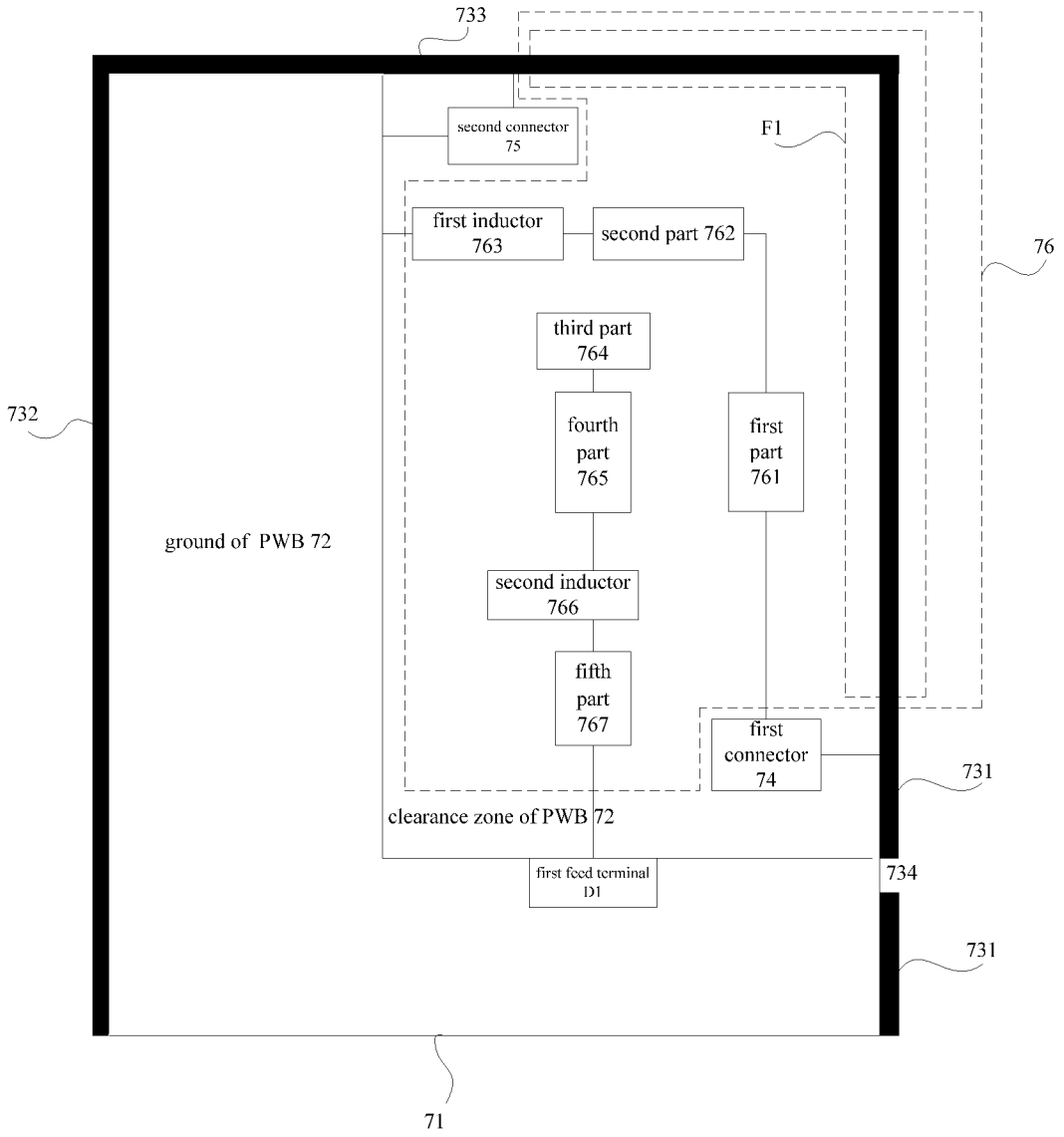
FIG. 7 is a schematic diagram of a mobile terminal according to a first embodiment of the present disclosure.

Embodiments of a second aspect of the present disclosure provide an antenna of the mobile terminal. FIG. 7 is a schematic diagram of a mobile terminal according to a first embodiment of the present disclosure. As shown in FIG. 7, the mobile terminal (such as a mobile phone) includes: a housing 71, a printed wiring board 72, a metal frame 73, a first connector 74, a second connector 75 and a first antenna 76.

The housing 71 covers the printed wiring board 72. The metal frame 73 surrounds the housing 71, and the metal frame 73 has a first frame 731, a second frame 732 and a third frame 733. The first frame 731 and the second frame 732 are disposed on two opposite sides of the housing 71 respectively, the third frame 733 is disposed on a top side of the housing 71 and is connected with the first frame 731 and the second frame 732 respectively, and the first frame 731 has a first gap 734. The first connector 74 has a first terminal connected with a part of the first frame 731 between the first gap 734 and the third frame 733 and a second terminal. The second connector 75 has a first terminal connected with the third frame 733 and a second terminal connected with a ground of the printed wiring board 72. The first antenna 76 includes a main radiator F1 of the first antenna, a first part 761, a second part 762, a first inductor 763 a third part 764, a fourth part 765, a second inductor 766 and a fifth part 767. The main radiator F1 of the first antenna consists of a part of the first frame and a part of the third frame connected between the first connector 74 and the second connector 75. The first part 761 has a first terminal connected with the second terminal of the first connector 74 and a second terminal, and is parallel with the first frame 731. The second part 762 has a first terminal connected with the second terminal of the first part 761 and a second terminal, and is parallel with the third frame 733. The first inductor 763 has a first terminal connected with the second terminal of the second part 762 and a second terminal connected with the ground of the printed wiring board. The first inductor 763 is a parallel inductor of an original "Loop" antenna of the first antenna 76. The third part 764 has a first terminal floated and a second terminal, and is parallel with the second part 762. The second part 762 is disposed between the third part 764 and the third frame 733, that is, the third part 764 is under the second part 762 (compared with the third part 764, the second part 762 is more close to a top of the housing 71). The fourth part 765 has a first terminal connected with the second terminal of the third part 764 and a second terminal, and is parallel with the first part 761. The second inductor 766 has a first terminal connected with the second terminal of the fourth part 765 and a second terminal. The fifth part 767 has a first terminal connected with the second terminal of the second inductor 766 and a second terminal connected with a first feed terminal of the printed wiring board 72, and is parallel with the first part 761. The second inductor 766 is a series inductor of the first antenna 76, and is configured to excite a high frequency band resonance of the first antenna 76.

In an embodiment, the third frame 733 has a first terminal and a second terminal, the first frame 731 has a first terminal and a second terminal, and the second frame 732 has a first terminal and a second terminal. The first terminal of the first frame 731 is connected with the first terminal of the third frame 733, and the first terminal of the second frame 732 is connected with the second terminal of the third frame 733.

Figure 8:
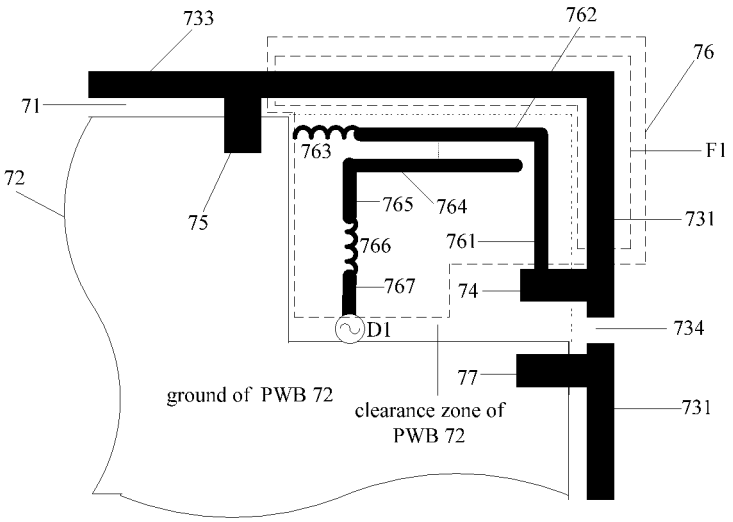
FIG. 8 is a schematic diagram of a mobile terminal according to a second embodiment of the present disclosure.

FIG. 8 is a schematic diagram of a mobile terminal according to a second embodiment of the present disclosure. In an embodiment, as shown in FIG. 8, there is a first predetermine distance (i.e., a space gap of about 0.5 mm, having an equivalent coupling capacitance) between the second part 762 and the third part 764 to form the capacitive coupling feed, and the capacitive coupling feed can excite the low frequency band resonance of the second antenna 710. Furthermore, the distance (a space gap of about 1.5 mm) between each of the fourth part 765, the second inductor 766 and the fifth part 767 and the ground of the printed wiring board 72 can be adjusted respectively.

As shown in FIG. 8, the mobile terminal further includes: a third connector 77, the third connector 77 has a first terminal connected with a part of the first frame 731 between the first gap 734 and the second terminal of the first frame 731 and a second terminal connected with the ground of the printed wiring board 72. In an embodiment, the first gap 734 may be disposed at a position which is a second predetermined distance (e.g., 10 mm~12 mm) away from a top of the housing 71, the first gap 734 may be a narrow gap which has a width of about 1.5 mm, and thus the first frame 731 of the metal frame 73 is disconnected at the first gap such that the first antenna 76 may radiate in this way. In an embodiment, the first gap 734 is disposed at a position which is 12 mm away from the top of the housing 71, a line width of each of the first part 761, the second part 762, the third part 764, the fourth part 765 and the fifth part 767 is 0.5 mm, the first inductor 763 is 17 nH, and the second inductor 766 is 6 nH.

In an embodiment, as shown in FIG. 8, the first antenna 76 can be disposed on the clearance zone of the printed wiring board 72 at the upper right corner of the mobile terminal, the ground of the printed wiring board 72 is disconnected on the clearance zone of the printed wiring board. The area of the clearance zone of the printed wiring board 72 is about 10*12 mm, the clearance zone of the printed wiring board 72 reserves the dielectric substrate of the printed wiring board to hold the first antenna 76 (such as the first part 761, the second part 762, the third part 764, the fourth part 765 and the fifth part 767) and to place antenna matching devices (such as the first inductor 763 and the second inductor 766).

In an embodiment, the second connector 75 is short-connected between the third frame 733 at the top of the housing 71 and the ground of the printed wiring board 72, meanwhile the second connector 75 enables an end of the original "Loop" antenna of the first antenna 76 grounded. In addition, in order to enable the impedance of the original "Loop" antenna of the first antenna 76 to fall into an appropriate fine-adjustable matching impedance area, a distance between the second connector 75 and an edge of the clearance zone of the printed wiring board 72 may vary with different required antenna frequency bands of the first antenna 76. For example, for the LTE Diversity antenna, the second connector 75 may be directly disposed at the edge of the clearance zone of the printed wiring board 72. For the GPS antenna, the BT antenna and the WLAN antenna, the second connector 75 may be disposed at a position which is about 10 mm~15 mm away from the edge of the clearance zone of the printed wiring board 72.

In an embodiment, once a structure, a shape and a size of the frame of the main radiator F1 is designed, there is no need to change the main radiator F1, while the resonance and the band width testing fully depend on fine adjustments of wiring of the first antenna 76 on the clearance zone of the printed wiring board 72. By changing a width and a length of the space gap between the third part 764 and the second part 762, an equivalent coupling capacitance is fine adjusted, such that the capacitive coupling feed can excite a low frequency band resonance required by the first antenna 76. By changing the inductance of the first inductor 763, the low frequency impedance of the first antenna 76 may be adjusted conveniently, and the low frequency band resonant frequency of the first antenna 76 is shifted. In an actual application, an end length of the third part 764 may be fine adjusted so as to change the equivalent coupling capacitance for a convenience of testing. In addition, the second inductor 766 can excite the high frequency band resonance required by the first antenna 76, and a high frequency band resonant frequency of the second inductor 766 can be adjusted by changing the inductance of the second inductor 766. By changing a width and a length of the space gap between the fourth part 765 and the ground of the printed wiring board 72, a loop area of the original "Loop" antenna of the first antenna 76 can be adjusted, and then the impedance of the first antenna 76 can be adjusted (for example, the fine-adjustment impedance of the first antenna 76 indicates a depth of the resonant point RL, or the RL point depth between the high frequency band resonance and the low frequency band resonance).

In an embodiment, the first antenna 76 may be a GPS antenna, a BT antenna, or a WLAN antenna.

Figure 9:
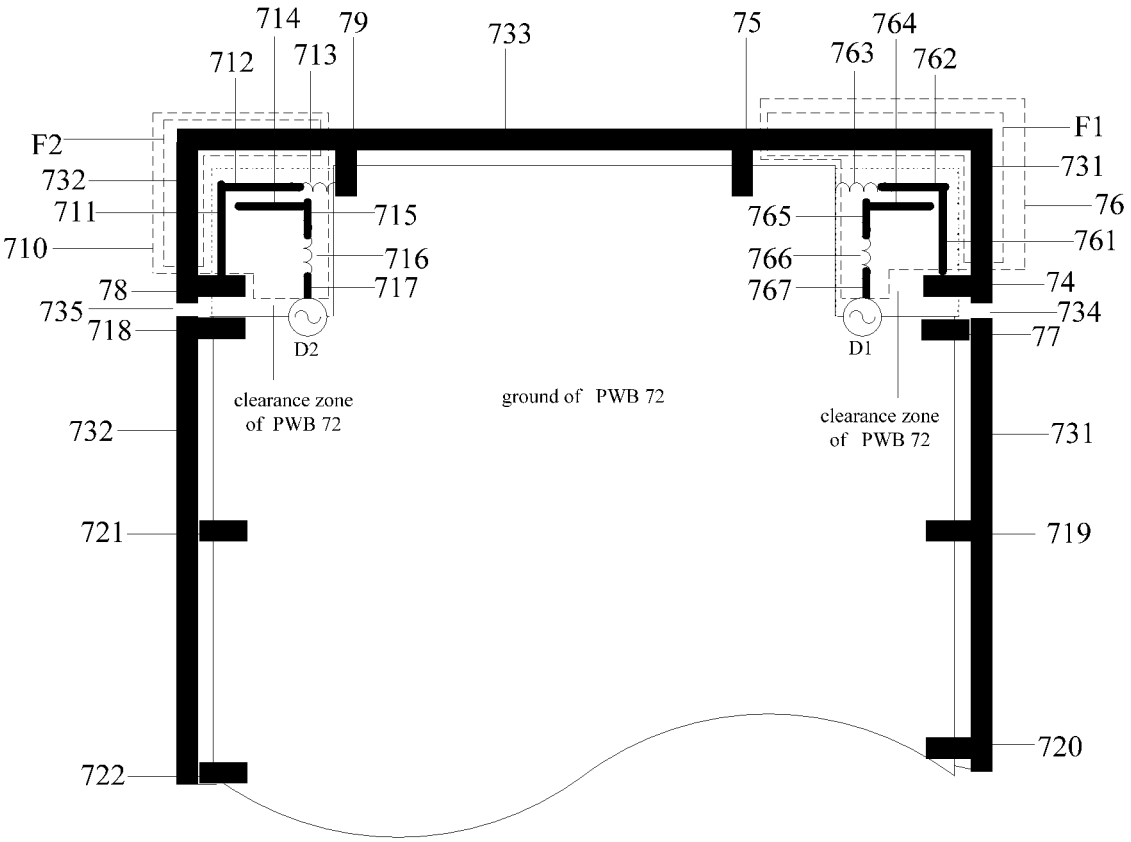
FIG. 9 is a schematic diagram of a mobile terminal according to a third embodiment of the present disclosure.

FIG. 9 is a schematic diagram of a mobile terminal according to a third embodiment of the present disclosure. As shown in FIG. 9, the second frame 732 has a second gap 735, and the mobile terminal further includes: a fourth connector 78, a fifth connector 79 and a second antenna 710. The fourth connector 78 has a first terminal connected with a part of the second frame 732 between the second gap 735 and the third frame 733. The fifth connector 79 has a first terminal connected with the third frame 733 and a second terminal connected with the ground of the printed wiring board 72. The second antenna 710 includes: a main radiator F2 of the second antenna, a sixth part 711, a seventh part 712, a third inductor 713, an eighth part 714, a ninth part 715, a fourth inductor 716, and a tenth part 717. The main radiator F2 of the second antenna consists of a part of the second frame and a part of the third frame connected between the fourth connector 78 and the fifth connector 79 (that is, a part of the second frame 732 between the fourth connector 78 and the third frame 733 and a part of the third frame 733 between the fifth connector 79 and the second frame 732). The sixth part 711 has a first terminal connected with the second terminal of the fourth connector 78 and a second terminal, and is parallel with the second frame 732. The seventh part 712 has a first terminal connected with the second terminal of the sixth part 711 and a second terminal, and is parallel with the third frame 733. The third inductor 713 has a first terminal connected with the second terminal of the seventh part 712 and a second terminal connected with the ground of the printed wiring board 72. The third inductor 713 is the parallel inductor of the second antenna 710. The eighth part 714 has a first terminal floated and a second terminal, and is parallel with the seventh part 712, and the seventh part 712 is disposed between the third frame 733 and the eighth part 714, that is, the eighth part 714 is under the seventh part 712 (compared with the eighth part 714, the seventh part 712 is more close to the top of the housing 71). The ninth part 715 has a first terminal connected with the second terminal of the eighth part 714 and a second terminal, and is parallel with the sixth part 711. The fourth inductor 716 has a first terminal connected with the second terminal of the ninth part 715. The tenth part 717 has a first terminal connected with a second terminal of the fourth inductor 716 and a second terminal connected with a second feed terminal D2 of the printed wiring board, and is parallel with the sixth part 711. The fourth inductor 716 is the series inductor of the second antenna 710, and is configured to excite the high frequency band resonance of the second antenna 710.

In an embodiment, as shown in FIG. 9, there is a first predetermine distance (i.e., a space gap of about 0.5 mm, having an equivalent coupling capacitance) between the seventh part 712 and the eighth part 714 to form the capacitive coupling feed, and the capacitive coupling feed can excite the low frequency band resonance of the second antenna 710. Furthermore, the distance (a space gap of about 1.5 mm) between each of the tenth part 717, the fourth inductor 716 and the tenth part 717 and the ground of the printed wiring board 72 can be adjusted respectively. In an embodiment, the second antenna 710 may be an LTE antenna (LTE Diversity antenna).

In an embodiment, as shown in FIG. 9, the mobile terminal further includes a sixth connector 718. The sixth connector 718 has a first terminal connected with a part of the second frame 732 between the second gap 735 and the second terminal of the second frame 732 and a second terminal connected with the ground of the printed wiring board 72. The second frame 732 under the second frame 732 is a metal frame between the second frame 732 and the bottom of the housing 71. In an embodiment, the second gap 735 can be disposed at a position which is a second predetermined distance (e.g., 10 mm~12 mm) away from the top of the housing 71, the second gap 735 can be a narrow gap which has a width of 1.5 mm, and thus the second frame 732 of the metal frame 73 is disconnected at the second gap such that the second antenna 710 may radiate in this way. In an embodiment, the second gap 735 is disposed at a position which is 12 mm away from the top of the housing 71, a line width of each of the sixth part 711, the seventh part 712, the eighth part 714, the ninth part 715 and the tenth part 717 is 0.5 mm, the third inductor 713 is 4 nH, and the second inductor 766 is 3.6 nH.

In an embodiment, a necessary ground point is designed, such that metal frames other than the main radiator F1 of the first antenna and the main radiator F2 of the second antenna can be well connected with the ground of the printed wiring board 72 or other metal ground (for example, an injected metal embedded in the housing 71), so as to ensure the mobile terminal is grounded. For example, the ninth connector 719 and the tenth connector 720 are designed, and thus the first frame 731 under the first gap 734 is connected with the ground of the printed wiring board 72, and the eleventh connector 721 and the twelfth connector 722 are designed, and thus the second frame 732 under the second gap 735 is connected with the ground of the printed wiring board 72.

In an embodiment, as shown in FIG. 9, the second antenna 710 can be disposed on a clearance zone of the printed wiring board 72 at the upper left corner of the mobile terminal, the ground of the printed wiring board 72 is disconnected on the clearance zone of the printed wiring board. An area of the clearance zone of the printed wiring board 72 is 10*12 mm, the clearance zone of the printed wiring board 72 reserves the dielectric substrate of the printed wiring board 72 to hold the second antenna 710 of the mobile terminal (such as the sixth part 711, the seventh part 712, the eighth part 714, the ninth part 715 and the tenth part 717) and to place antenna matching devices (such as the third inductor 713 and the fourth inductor 716).

In an embodiment, the fifth connector 79 is short-connected between the third frame 733 at the top of the housing 71 and the ground of the printed wiring board 72, meanwhile the fifth connector 79 enables an end of the original "Loop" antenna of the second antenna 710 grounded. In addition, in order to enable the impedance of the original "Loop" antenna of the second antenna 710 to fall into an appropriate fine-adjustable matching impedance area, a distance between the fifth connector 79 and an edge of the clearance zone of the printed wiring board 72 may vary with different required antenna frequency bands of the second antenna 710. For example, for the LTE Diversity antenna, the fifth connector 79 may be directly disposed at the edge of the clearance zone of the printed wiring board 72; for the GPS antenna, the BT antenna and the WLAN antenna, the fifth connector 79 may be disposed at the position which is about 10 mm-15 mm away from the edge of the clearance zone of the printed wiring board 72.

In an embodiment, once a structure, a shape and a size of the frame of the main radiator F2 of the second antenna is designed, there is no need to change the main radiator F2 of the second antenna, while the resonance and the band width testing fully depend on fine adjustments of wiring of the second antenna 710 on the clearance zone of the printed wiring board 72. By changing a width and a length of the space gap between the seventh part 712 and the eighth part 714, an equivalent coupling capacitance is fine adjusted, such that the capacitive coupling feed can excite a low band resonant needed by the second antenna 710. By changing the inductance of the fourth inductor 716, the low frequency impedance of the second antenna 710 may be adjusted conveniently, and the low frequency band resonant frequency of the second antenna 710 is shifted. In an actual application, an end length of the eighth part 714 may be adjusted so as to change the equivalent coupling capacitance for a convenience of testing. In addition, the fourth inductor 716 can excite the high frequency band resonance required by the second antenna 710, a high frequency band resonant frequency of the fourth inductor 716 can be adjusted by changing the inductance of the fourth inductor 716. By changing a width and a length of the space gap between the ninth part 715 and the ground of the printed wiring board 72, a loop area of the original "Loop" antenna of the second antenna 710 can be adjusted, and then the impedance of the second antenna 710 can be adjusted (for example, the fine adjustment impedance of the second antenna 710 indicates a depth of the resonant point RL, or the RL point depth between the high frequency band resonance and the low frequency band resonance).

Figure 10:
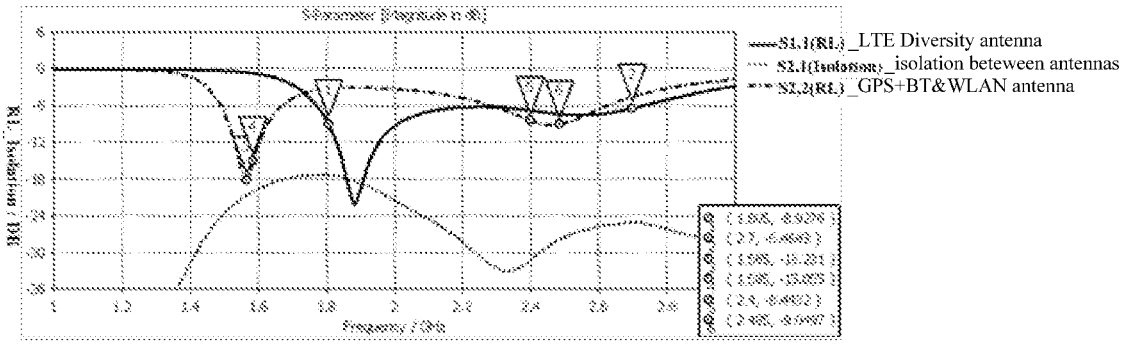
FIG. 10 is a schematic diagram showing an impedance frequency curve and an isolation frequency curve corresponding to a first antenna and a second antenna according to an embodiment of the present disclosure.
Figure 11:
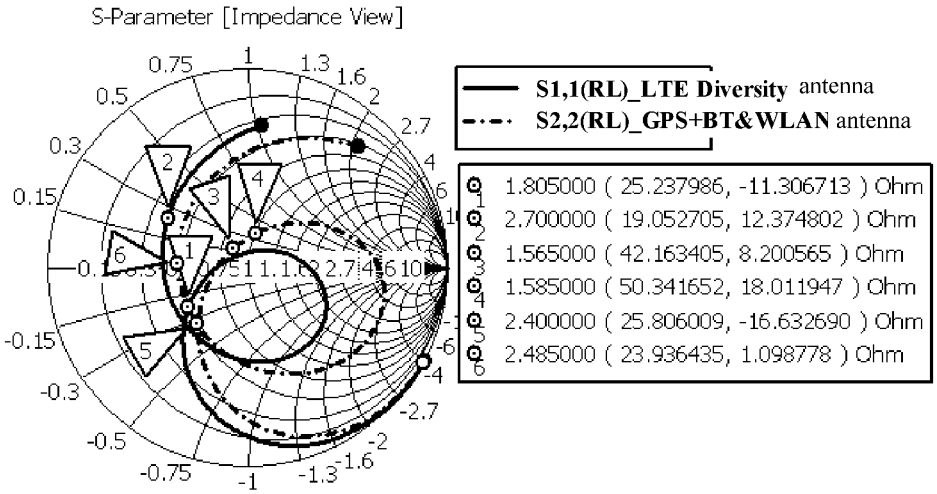
FIG. 11 is a schematic diagram showing an RL frequency curve corresponding to the first antenna and the second antenna according to an embodiment of the present disclosure.

FIG. 10 is a schematic diagram showing an impedance frequency curve and an isolation frequency curve corresponding to the first antenna and the second antenna according to an embodiment of the present disclosure. FIG. 11 is a schematic diagram showing an RL frequency curve corresponding to the first antenna and the second antenna according to an embodiment of the present disclosure. The first antenna 76 is a GPS antenna, a BT antenna, or a WLAN antenna and the second antenna 710 is an LTE Diversity antenna. As shown in FIG. 10 and FIG. 11, a bandwidth performance of an impedance of the first antenna 76 and the second antenna 710 of the mobile terminal is good, and an isolation between the first antenna 76 and the second antenna 710 can meet requirements (a typical isolation is less than −15 dB).

With the mobile terminal according to embodiments of the present disclosure, the antenna is divided into two parts, the main radiators formed by the corner metal frames and the antenna feed and the matching network part on the clearance zone of the printed wiring board 72, the antenna is not required to be formed onto an isolated plastic support or a plastic housing by using an FPC or LDS process, and the main radiators formed by the corner metal frames are different from the traditional antenna, the fine adjustment of the resonant frequency and the bandwidth of the antenna does not rely on adjustments of the dimensions of the mental frames, so that once the structure of the mobile terminal (such as the mobile phone), especially the metal frame 73 is designed, the metal frame 73 can be remained without changing structure. In addition, the antenna feed and matching network portion is disposed on the clearance zone of about 10*12 mm of the printed wiring board 72, the fine adjustment of the resonant frequency and the bandwidth of the antenna can be achieved by fine adjusting the antenna feed and matching network portion. Furthermore, after the integrated basic structure of the antenna is determined, the fine adjustment for the low frequency resonance and the high frequency resonance can be achieved by fine adjusting the parallel inductor in the loop (such as the first inductor 763, the third inductor 713) and the series inductor in the feed circuit (the second inductor 766, the fourth inductor 716).

The mobile terminal according to embodiments of the present disclosure has the following advantages: first, there is no additional antenna element required, thus greatly reducing a cost; second, for the antenna testing during the product development, it is not required to perform a fine adjustment to the shape and dimension of the metal frame, so as to avoid modifying the mold for fabricating the metal frame, to accelerate the development and testing of the antenna, and the testing is convenient and flexible; third, in the premise of ensuring the necessary antenna RF performance, the antenna occupies a small area of the printed wiring board, which greatly saves the valuable space of the printed wiring board.

Any procedure or method described in the flow charts or described in any other way herein may be understood to comprise one or more modules, sections or parts for storing executable codes that realize particular logic functions or procedures. Moreover, advantageous embodiments of the present disclosure comprises other implementations in which the order of execution is different from that which is depicted or discussed, including executing functions in a substantially simultaneous manner or in an opposite order according to the related functions. This should be understood by those skilled in the art which embodiments of the present disclosure belong to.

The logic and/or step described in other manners herein or shown in the flow chart, for example, a particular sequence table of executable instructions for realizing the logical function, may be specifically achieved in any computer readable medium to be used by the instruction execution system, device or equipment (such as the system based on computers, the system comprising processors or other systems capable of obtaining the instruction from the instruction execution system, device and equipment and executing the instruction), or to be used in combination with the instruction execution system, device and equipment.

It is understood that each part of the present disclosure may be realized by the hardware, software, firmware or their combination. In the above embodiments, a plurality of steps or methods may be realized by the software or firmware stored in the memory and executed by the appropriate instruction execution system. For example, if it is realized by the hardware, likewise in another embodiment, the steps or methods may be realized by one or a combination of the following techniques known in the art: a discrete logic circuit having a logic gate circuit for realizing a logic function of a data signal, an application-specific integrated circuit having an appropriate combination logic gate circuit, a programmable gate array (PGA), a field programmable gate array (FPGA), etc.

Those skilled in the art shall understand that all or parts of the steps in the above exemplifying method of the present disclosure may be achieved by commanding the related hardware with programs. The programs may be stored in a computer readable storage medium, and the programs comprise one or a combination of the steps in the method embodiments of the present disclosure when run on a computer.

In addition, each function cell of the embodiments of the present disclosure may be integrated in a processing module, or these cells may be separate physical existence, or two or more cells are integrated in a processing module. The integrated module may be realized in a form of hardware or in a form of software function modules. When the integrated module is realized in a form of software function module and is sold or used as a standalone product, the integrated module may be stored in a computer readable storage medium.

The storage medium mentioned above may be read-only memories, magnetic disks or CD, etc.

Reference throughout this specification to "an embodiment," "some embodiments," "one embodiment", "another example," "an example," "a specific example," or "some examples," means that a particular feature, structure, material, or characteristic described in connection with the embodiment or example is included in at least one embodiment or example of the present disclosure. Thus, the appearances of the phrases such as "in some embodiments," "in one embodiment", "in an embodiment", "in another example," "in an example," "in a specific example," or "in some examples," in various places throughout this specification are not necessarily referring to the same embodiment or example of the present disclosure. Furthermore, the particular features, structures, materials, or characteristics may be combined in any suitable manner in one or more embodiments or examples.

Although explanatory embodiments have been shown and described, it would be appreciated by those skilled in the art that the above embodiments cannot be construed to limit the present disclosure, and changes, alternatives, and modifications can be made in the embodiments without departing from spirit, principles and scope of the present disclosure.

What is claimed is:

1. A mobile terminal, comprising:

a printed wiring board;

a housing;

a metal frame surrounding the housing, and having a first frame, a second frame and a third frame, wherein the first frame and the second frame are disposed on two opposite sides of the housing respectively, the third frame is disposed on a top side of the housing and is connected with the first frame and the second frame respectively, and the first frame has a first gap;

a first connector, having a first terminal connected with a part of the first frame between the first gap and the third frame and a second terminal;

a second connector, having a first terminal connected with the third frame and a second terminal connected with a ground of the printed wiring board; and a first antenna, comprising:

a main radiator of the first antenna consisting of a part of the first frame and a part of the third frame connected between the first connector and the second connector;

a first part, having a first terminal connected with the second terminal of the first connector and a second terminal, and parallel with the first frame;

a second part, having a first terminal connected with the second terminal of the first part and a second terminal, and parallel with the third frame;

a first inductor, having a first terminal connected with the second terminal of the second part and a second terminal connected with the ground of the printed wiring board;

a third part, having a first terminal floated and a second terminal, and parallel with the second part, wherein the second part is disposed between the third part and the third frame;

a fourth part, having a first terminal connected with the second terminal of the third part and a second terminal, and parallel with the first part;

a second inductor, having a first terminal connected with the second terminal of the fourth part and a second terminal; and a fifth part, having a first terminal connected with the second terminal of the second inductor and a second terminal connected with a first feed terminal of the printed wiring board, and parallel with the first part.

2. The mobile terminal of claim 1 wherein the third frame has a first terminal and a second terminal;

the first frame has a first terminal connected with the first terminal of the third frame and a second terminal;

the second frame has a first terminal connected with the second terminal of the third frame and a second terminal.

3. The mobile terminal of claim 2 further comprising:

a third connector, having a first terminal connected with a part of the first frame between the first gap and the second terminal of the first frame and a second terminal connected with the ground of the printed wiring board.

4. The mobile terminal of claim 1 wherein there is a first predetermined distance between the second part and the third part to form a capacitive coupling feed.

5. The mobile terminal of claim 1 wherein the first antenna is a GPS antenna, a Bluetooth antenna, or a WLAN antenna.

6. The mobile terminal of claim 3 wherein the second frame has a second gap.

7. The mobile terminal of claim 6 further comprising:

a fourth connector, having a first terminal connected with a part of the second frame between the second gap and the third frame, and a second terminal;

a fifth connector, having a first terminal connected with the third frame and a second terminal connected with the ground of the printed wiring board; and a second antenna, comprising:

a main radiator of the second antenna consisting of a part of the second frame and a part of the third frame connected between the fourth connector and the fifth connector;

a sixth part, having a first terminal connected with the second terminal of the fourth connector and a second terminal, and parallel with the second frame;

a seventh part, having a first terminal connected with the second terminal of the sixth part and a second terminal, and parallel with the third frame;

a third inductor, having a first terminal connected with the second terminal of the seventh part and a second terminal connected with the ground of the printed wiring board;

an eighth part, having a first terminal floated and a second terminal, and parallel with the seventh part, wherein the seventh part is disposed between the third frame and the eighth part;

a ninth part, having a first terminal connected with the second terminal of the eighth part and a second terminal, and parallel with the sixth part;

a fourth inductor, having a first terminal connected with the second terminal of the ninth part and a second terminal; and a tenth part, having a first terminal connected with the second terminal of the fourth inductor and a second terminal connected with a second feed terminal of the printed wiring board, and parallel with the sixth part.

8. The mobile terminal of claim 7 further comprising:

a sixth connector, having a first terminal connected with a part of the second frame between the second gap and the second terminal of the second frame and a second terminal connected with the ground of the printed wiring board.

9. The mobile terminal of claim 6 wherein each of the first gap and the second gap is disposed at a position which has a second predetermined distance from the top side of the housing.

10. The mobile terminal of claim 7 wherein there is a first predetermined distance between the seventh part and the eighth part to form a capacitive coupling feed.

11. The mobile terminal of claim 7 wherein the second antenna is an LTE antenna.

* * * * *